US005430452A

United States Patent [19]

DuBois

[11] Patent Number: 5,430,452

[45] Date of Patent: Jul. 4, 1995

[54] DEVICE FOR SUPPLY TO THE RADIATING ELEMENTS OF AN ARRAY ANTENNA, AND APPLICATION THEREOF TO AN ANTENNA OF AN MLS TYPE LANDING SYSTEM

[75] Inventor: Serge DuBois, deceased, late of Conflans Sainte Honorine, France, by Jeannine Godin, Thierry DuBois, Didier DuBois, Brigitte DuBois and Gilles DuBois all legal representative

[73] Assignee: Thomson-CSF, Puteaux, France

[21] Appl. No.: 149,132

[22] Filed: Nov. 8, 1993

Related U.S. Application Data

[63] Continuation of Ser. No. 710,572, Jun. 5, 1991, abandoned.

[30] Foreign Application Priority Data

Jun. 19, 1990 [FR] France ..... 90 07641

[51] Int. Cl.[6] ..... H01Q 3/22; H01Q 3/24

[52] U.S. Cl. ..... 342/368; 342/372; 342/373

[58] Field of Search ..... 342/371, 372, 373, 368, 342/408, 154, 157

[56] References Cited

U.S. PATENT DOCUMENTS 3,509,577 4/1970 Kinsey .
4,117,494 9/1978 Frazita .
4,122,453 10/1978 Profera .
4,228,436 10/1980 Dufort .
4,692,768 9/1987 Becavin ..... 342/373
4,721,960 1/1988 Lait ..... 342/372
4,907,004 3/1990 Zacharatos et al. ..... 342/373

FOREIGN PATENT DOCUMENTS 2210841 12/1973 France .
2034525 11/1978 United Kingdom .

OTHER PUBLICATIONS

DuFort, Edward C., Low Sidelobe Electronically Scanned Antenna Using Identical Transmit/Receive Modules, 8082 I.E.E.E. Transactions on Antennas and Propagation 36 (1988) Mar., No. 3, New York, N.Y. USA, pp. 349–356.

*Primary Examiner*—Theodore M. Blum
*Attorney, Agent, or Firm*—Meltzer, Lippe, Goldstein et al.

[57] ABSTRACT

Disclosed is a device for supply to the radiating elements of an array antenna with electronic scanning, notably applicable to an MLS type landing system. The disclosed antenna has as many (n) phase-shifters as it has radiating elements each of the phase-shifters being connected to a plurality (m) of neighboring radiating elements forming a sub-array. The sub-arrays are interleaved so that each of the radiating elements is supplied by means of m phase-shifters. As a result, an array antenna with very small minor lobes is obtained.

4 Claims, 3 Drawing Sheets

DEVICE FOR SUPPLY TO THE RADIATING ELEMENTS OF AN ARRAY ANTENNA, AND APPLICATION THEREOF TO AN ANTENNA OF AN MLS TYPE LANDING SYSTEM

This is a continuation of application Ser. No. 07/710,572 filed Jun. 5,1991, now abandoned.

BACKGROUND OF THE INVENTION

1. Field of the Invention

An object of the invention is a device for the supply of the radiating elements of an array antenna capable of transmitting and receiving microwaves that carry out an electrical scanning of space. An antenna such as this is notably applicable to the landing system known as the MLS (microwave landing system).

2. Description of the Prior Art

It may be recalled that an array antenna is constituted by a plurality of radiating elements, each of which simultaneously transmits a microwave, the resultant of which forms a main beam (or major lobe) in a given direction, accompanied by a spatial distribution of smaller amplitude, known as side or spurious lobes. Each radiating element is connected to an electronically controllable phase-shifter. The control of the phase-shifters makes it possible to scan space with the main beam.

In certain applications, such as the MLS, the inconvenience caused by the side lobes may be very great, to the extent of causing the supply of false information, such as a false axis of descent. This is a serious fault in a system for guiding aircraft in the particularly critical stage of landing.

SUMMARY OF THE INVENTION

An object of the present invention is an array antenna, the side lobes of which are very small, at least in the vicinity of the main lobe transmitted by the antenna. An antenna such as this can be used, in an MLS-type application, to prevent the supply of information that may be wrongly interpreted by the guided aircraft.

To this effect, the antenna has as many (n) phase-shifters as it has radiating elements, each of the phase-shifters being connected to a plurality (m) of neighboring radiating elements forming a sub-array, the sub-arrays being interleaved so that each of the radiating elements is supplied by means of m phase-shifters.

BRIEF DESCRIPTION OF THE DRAWINGS

Other objects, special features and results of the invention shall emerge from the following description, given as a non-restrictive example and illustrated by the appended drawings, of which.

In these different figures, the same references are repeated for the same elements.

Besides, with a view to simplicity, the working of the array antenna incorporating the present invention shall be described solely with respect to the transmission mode, it being understood that it is capable of working, reciprocally, also in the receiver mode.

DETAILED DESCRIPTION OF THE INVENTION

Figure 1:
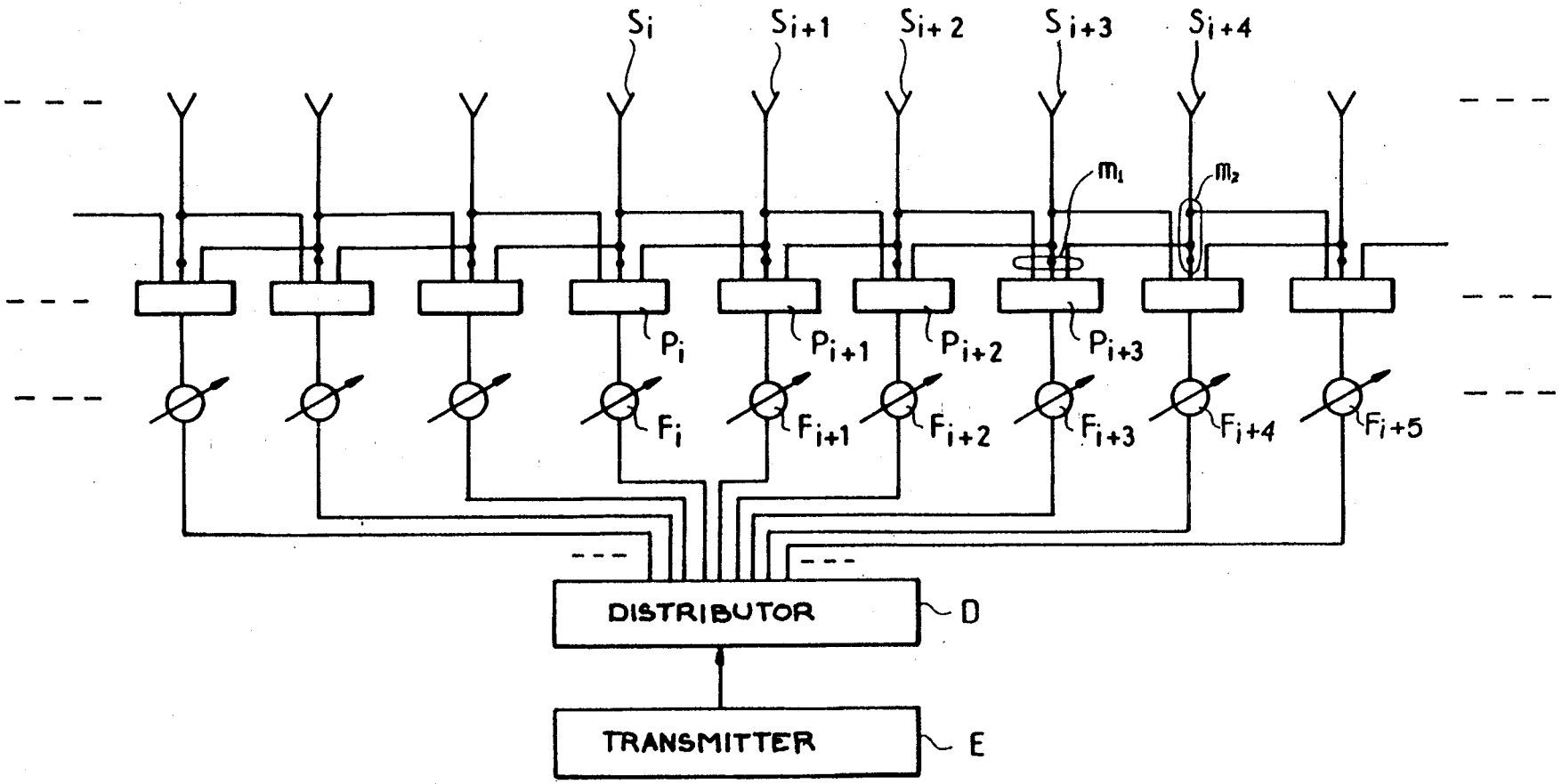
FIG. 1 is a diagram of an embodiment of the supply device according to the invention.

FIG. 1 is therefore a diagram of an exemplary embodiment of the supply device according to the invention.

This device is designed to supply an array of n radiating elements, also called elementary sources. Nine of these sources are shown in the diagram and four of them are referenced $S_i$, $S_{i+1}$, $S_{i+2}$ and $S_{i+3}$, i being equal to a value ranging from 1 to n. These $n^{-3}$sources transmit microwave electromagnetic energy given by a transmitter set E, by means of the device according to the invention.

This device has:

- a set of n phase-shifters, nine of them being shown in the figure, and four being referenced F , $F_{i+1}$, $F_{i+2}$, $F_{i+3}$ with i being a value ranging from 1 to $n^{-3}$;
- weighting means: in FIG. 1, these means have been shown in the form of nine distinct circuits, four of them being referenced $P_i$, $P_{i+1}$, $P_{i+2}$, $P_{i+3}$ with i being a value varying from 1 to $n^{-3}$;
- and a distribution circuit D, enabling each of the phase-shifters F to receive the energy given by the transmitter E.

Each phase-shifter F is connected to the radiating elements by means of the weighting means which are given the overall reference P. According to the invention, each of the phase-shifters F is connected, by means of the weighting circuit, to m elementary neighboring sources F. Conversely, each of the sources S is connected to m neighboring phase-shifters F. For example, m is equal to three in the figure. Thus, n sub-arrays have been formed, each supplied by a phase-shifter and having m sources in interleaved fashion, the distance between two sub-arrays being then equal to the distance between two sources.

As is known, the radiation pattern of an array such as this is obtained from the radiation pattern of a sub-array multiplied by a function that is known as the array factor and that accounts for the fact that there are several sub-arrays. The role of the weighting circuits P is, as the case may be, to give the radiation pattern of the sub-array, to which it is connected, a shape that is as close as possible to the desired shape.

Figure 2:
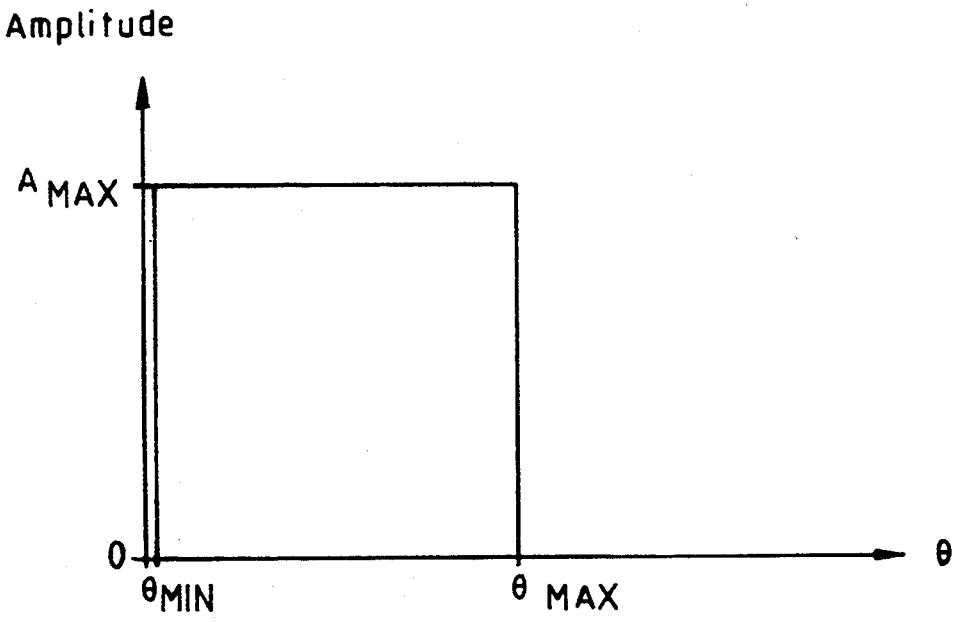
FIG. 2 is an explanatory graph.

By way of an example, FIG. 2 shows the ideal radiation pattern that should be exhibited by a sub-array of the elevation antenna of an MLS system.

The amplitude of the radiation should be the maximum ($A_{max}$) for an elevation angle with a value ranging from $\theta_{min}$ and $\theta_{max}$, and zero outside these two values. The interval ($\theta_{min};\theta_{max}$) represents the coverage that an elevation MLS station should have, namely the angular sector scanned by the major lobe. In practice, the width of the MLS major lobe in the elevation plane is of the order of 1° to 2° and the coverage is 0° to 17°.

In effect when, as is the case herein, the main lobe is transmitted at small elevation angles, the side lobes get reflected on the ground and may consequently be picked up by an aircraft located in the zone of coverage of the antenna, thus giving rise to false information. The side lobes should therefore be particularly small (for example of the order of −40 dB in relation to the main lobe) in the vicinity of the main lobe: typically, for this type of application, in a zone of about ±20° about the main lobe. As has been stated here above, the complete antenna pattern is given by the product of the pattern of the sub-array by the array factor. With a sub-array pattern as illustrated in FIG. 2, it can be seen that the product is necessarily zero outside the coverage zone. More particularly, the product is zero and there are no side lobes for the small elevation values of less than $\theta_{min}$, thus preventing reflections on the ground.

When the device according to the invention is applied to an MLS elevation antenna, it is thus sought to obtain a pattern, for the radiation pattern of a sub-array, that is as close as possible to the one shown in FIG. 2.

Since this pattern is the Fourier transform of the relationship of amplitude applied to the sources constituting the sub-array, the function of the weighting means P is to apply, to the sources that they control, a relationship of amplitude that is as close as possible to a relationship of the type $$\frac{\sin U}{U},$$

for $$\frac{\sin U}{U},$$

which it may be recalled that the Fourier transform is a rectangular function of the type illustrated in FIG. 2.

As mentioned further above, the radiation pattern of the entire antenna is obtained by taking the product of the pattern of a sub-array and the array factor. In the present case, this factor is a function whose shape is close to a function $$\frac{\sin U}{U}$$

It is thus seen that it is possible, in this way, to obtain a resultant pattern with a main lobe that may be fine and with very small side lobes.

For, the weighting due to the means P can never be used, in practice, to obtain a perfectly rectangular radiation, notably because of the discrete nature of the sources and their finite number. The real radiation has side lobes that may typically, in the exemplary application shown in FIG. 2, display an attenuation of the order of −20 dB with respect to the main lobe. However, since the array factor is a function that also shows a main lobe and side lobes, the attenuation of which may be of the same order (−20 dB), the product of these two values makes it possible to obtain highly attenuated side lobes (about −40 dB in the previous example).

Furthermore, in a preferred embodiment, the distributor D of FIG. 1 may, in a preferred way, achieve a weighting of the amplitude of the energy applied to the sources (Chebyshev weighting or Taylor weighting for example) which have the effect of further reducing the side lobes of the pattern of the antenna, at a given main lobe width.

Besides, it is well known that the grouping together of the elementary sources into sub-arrays prompts the appearance of spurious lobes, called grating lobes, due to the periodicity of the sub-arrays, and the amplitude of these grating lobes may be very great. The grating lobes appear as soon as the ratio $d/\lambda$ becomes greater than:

$$\frac{1}{1 + \sin\theta_{max}}$$

where d is the distance between sub-arrays;

$\lambda$ is the operating wavelength of the antenna;

$\theta_{max}$ is the maximum scanning angle.

According to the invention, the sub-arrays are interleaved in such a way that the distance between two sub-arrays is equal to the distance between two elementary sources. This means that the existence of sub-arrays introduces no additional disturbance.

Figure 3:
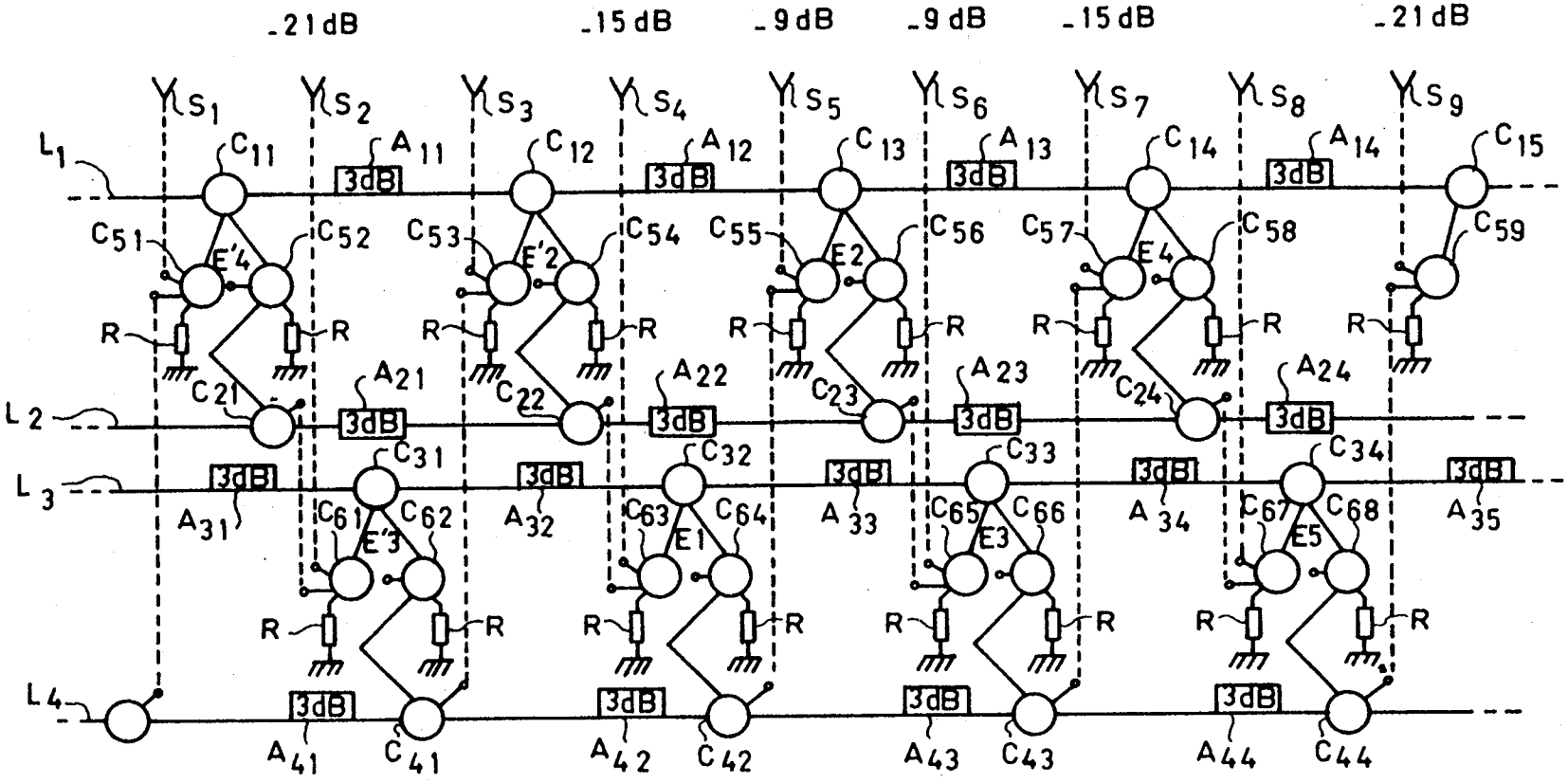
FIG. 3 shows an electronic diagram of a practical embodiment of the device according to the invention.

FIG. 3 shows the electronic diagram of a practical embodiment of the device according to the invention.

The figure shows nine of the n elementary sources that are capable of supplying the device according to the invention, as well as the part of the weighting circuits P (FIG. 1) that corresponds to them.

The device has four connection lines, referenced $L_1$ to $L_4$. On these lines there are positioned, firstly, attenuators, referenced $A_{ij}$ where i represents the line number and j the order number of the attenuator on the line and, secondly, 3 dB hybrid bridges, referenced $C_{ij}$, the notation ij having the same meaning as here above.

The attenuators A are provided with two input-output ports, between which they communicate a 3 dB attenuation to the signal that goes through them. These attenuators may be formed by any known means, for example T attenuators or $\pi$ attenuators with resistors.

The bridges C have four input-output ports, two of which are connected to the line that bears them. Their function is to transmit the energy that they receive at one input to the two adjacent outputs, i.e. with a 3 dB attenuation at each input. They are represented in the figure by a circle, and two of their input-output ports are diametrically opposite. By convention, the hybrid bridge further introduces a 180° phase-shift between these two ports. These bridges are made by any known means, notably as described in the article by J. Reed and G.J. Wheeler, "A Method of Analysis of Symmetrical Four-Port Networks" in the journal *IRE Transactions on Microwave Theory and Techniques*, Oct. 1956.

The device according to the invention further has a first series of 3 dB hybrid bridges referenced $C_{5j}$, where j is an order number, positioned between the lines $L_1$ and $L_2$ and designed to connect the bridges borne by these lines, and a second series of hybrid bridges similarly referenced $C_{6j}$, positioned between the lines $L_3$ and $L_4$ and connecting the bridges borne by these lines. The bridges $C_{5j}$ and $C_{6j}$ are of the same type as the preceding ones, and have four input-output ports, but here one of them is, in a known way, connected to a load resistor designed to absorb the spurious energies. At one of the their inputs, referenced $E_j$(j being an order number), the even-order hybrid bridges $C_{5j}$ and $C_{6j}$ receive a connection with one of the phase-shifters F of FIG. 1.

The connection of the different components of the circuit of FIG. 3, as well as its operation, are described here below in following the path of the energy given by that phase-shifter, among the phase-shifters F, which is connected, for example, to the input $E_2$ of the hybrid bridge 56 shown in FIG. 3, it being understood that the same basic cell gets reproduced successively from one element to the next one for the n radiating elements of the antenna. Load impedances are further provided at the end of the antenna, in a known way, to terminate the circuit. It must be noted that certain connections are shown in the figure by solid lines and others are shown by dashes: the circuit is made, for example, on a multiple-layer printed circuit, the connections shown by dashes being made, for example, on a concealed face.

The energy applied to the input $E_2$ will supply the source $S_5$ by means of the bridges $C_{13}$ and $C_{55}$, hence with an attenuation of 9 dB with respect to the level of the signal applied to the input $E_2$. This same signal also supplies the source $S_6$ by means of the bridges $C_{23}$ and $C_{65}$ with the same 9 dB attenuation. The energy applied to the input $E_2$ also supplies the source $S_7$, by means of the bridges $C_{13}$, $C_{14}$ and $C_{57}$, as well as the attenuator $A_{13}$, with a 15 dB attenuation. Symmetrically, the energy applied at $E_2$ supplies the source $S_4$ by means of the bridges $C_{23}$, $C_{22}$ and $C_{63}$, as well as the attenuator $A_{22}$, also with a 15 dB attenuation. The energy, radiated by the sources $S_3$ and $S_8$ because of the energy applied at the input $E_2$, is negligible owing to the very large number of attenuations that are applied to it. Finally, the sources $S_9$ and $S_2$ both transmit an energy attenuated by 21 dB and phase-shifted by 180° as compared with the energy applied to the input $E_2$, by the following paths:

for the source $S_9$: by means of the bridge $C_{13}$, the attenuator $A_{13}$, the bridge $C_{14}$ with a 180° phase-shift, the attenuator $A_{14}$ and the bridges $C_{15}$ and $C_{59}$;

for the source $S_2$: by means of the bridge $C_{23}$, the attenuator $A_{22}$, the bridge $C_{22}$ with a 180° phase-shift, the attenuator $A_{21}$ and the bridges $C_{21}$ and $C_{61}$;

It appears that an amplitude distribution is obtained closed to the desired $$\frac{\sin U}{U}$$

shape.

It must be noted that, in this embodiment, each of the phase-shifters is connected, through the circuit described, to all the sources S (in other words m=n) but that only six sources ($S_2$, $S_4$, $S_5$, $S_6$, $S_7$ and $S_9$ in the figure) are so connected in a significant way, the energy that reaches the other sources being far too attenuated. An advantage of this structure is its simplicity.

It must also be noted that the attenuations introduced by the attenuators A or the bridges C are not obligatorily equal to 3 dB: they may be modified to enable the desired shape of the radiation pattern to be approached as closely as possible.

What is claimed is:

1. A device for the supply of an array antenna comprising n radiating elements, said device comprising n phase shifters, and a plurality of subsets of said n radiating elements wherein each of said n phase shifters is connected to one of said plurality of subsets and each of said subsets comprises m adjacent radiating elements which form a subarray of radiating elements, wherein each subarray is interleaved so that each of said m radiating elements is supplied by a subset comprising m phase shifters of said n phase shifters.

2. A device according to claim 1, further comprising plurality of weighting elements, wherein each of said plurality of weighting elements is connected to a phase-shifter and the subarray of m radiating elements connected to that phase-shifter, thereby giving the subarrays a predefined radiation pattern.

3. A device according to claim 2, wherein each of said n phase-shifters is connected to n radiating elements and said weighting elements give a weighting such that only m radiating elements of said n radiating elements, with $m<n$, are supplied with a non-negligible level of energy.

4. An application of the device, according to claim 1, to the supply of radiating elements of an array antenna of an MLS type landing assistance system.

* * * * *